US008215139B2

(12) United States Patent
Sindersen et al.

(10) Patent No.: US 8,215,139 B2
(45) Date of Patent: Jul. 10, 2012

(54) APPARATUS FOR REMOVAL OF DRIED FURS FROM A PELTING BOARD

(75) Inventors: Vagn Sindersen, Vinderup (DK); Kurt Pedersen, Vinderup (DK)

(73) Assignee: 4M Globe Management Ltd, Bishop's Stortford (GB)

( * ) Notice: Subject to any disclaimer, the term of this patent is extended or adjusted under 35 U.S.C. 154(b) by 17 days.

(21) Appl. No.: 12/528,113

(22) PCT Filed: Feb. 21, 2008

(86) PCT No.: PCT/DK2008/000075

§ 371 (c)(1),
(2), (4) Date: Nov. 8, 2010

(87) PCT Pub. No.: WO2008/101501

PCT Pub. Date: Aug. 28, 2008

(65) Prior Publication Data

US 2011/0041568 A1 Feb. 24, 2011

(30) Foreign Application Priority Data

Feb. 21, 2007 (DK) ..... 2007 00271

(51) Int. Cl.
*C14B 15/00* (2006.01)

(52) U.S. Cl. ..... 69/23

(58) Field of Classification Search ..... 69/22, 23; D5/28

See application file for complete search history.

(56) References Cited

U.S. PATENT DOCUMENTS

| | | | | |
|---|---|---|---|---|
| 3,313,038 | A * | 4/1967 | Bolz | 34/103 |
| 4,856,201 | A * | 8/1989 | Dokoupil et al. | 34/263 |
| 7,690,228 | B2 * | 4/2010 | Hedegaard | 69/19.1 |
| 7,784,312 | B2 * | 8/2010 | Hedegaard | 69/19 |
| 2004/0060330 | A1 * | 4/2004 | Hedegaard | 69/21 |
| 2007/0028655 | A1 * | 2/2007 | Hedegaard | 69/21 |
| 2007/0061979 | A1 * | 3/2007 | Hedegaard | 8/94.16 |
| 2009/0007604 | A1 * | 1/2009 | Hedegaard | 69/19.3 |
| 2009/0019898 | A1 * | 1/2009 | Hedegaard | 69/22 |

FOREIGN PATENT DOCUMENTS

| | | | |
|---|---|---|---|
| DK | 175872 | B1 | 3/2004 |
| WO | WO 2005/026394 | | 3/2005 |
| WO | WO 2007/071259 | A1 | 6/2007 |
| WO | WO 2007/085269 | A1 | 8/2007 |
| WO | WO 2007/093185 | A1 | 8/2007 |

* cited by examiner

*Primary Examiner* — Shaun R Hurley
(74) *Attorney, Agent, or Firm* — Antonelli, Terry, Stout & Kraus, LLP.

(57) ABSTRACT

An apparatus (2) for removal of dried furs from pelting boards (8) upon which the fur during the drying process has been fixed. The apparatus removes furs from the pelting boards (8) in an upright position that are successively supplied in upright position, and which at a wide end of the pelting boards are fixed in fixing holes in a top plate of a drying cart (6) in such a way that the upright pelting boards (8) with furs are in transverse and longitudinal rows. The apparatus (2) includes a conveying tunnel (4); a guide for guiding a longitudinal side of the drying cart; a transverse upper guide (14); a secondary guide (16, 18); a primary laterally displaceable lift (30) for clamping a pointed end of the furs; and a secondary lift (50).

14 Claims, 8 Drawing Sheets

APPARATUS FOR REMOVAL OF DRIED FURS FROM A PELTING BOARD

BACKGROUND OF THE INVENTION

Field of the Invention

The present invention relates to an apparatus for removal of dried furs from a pelting board.

DK PA 2002 01831 and WO 2005/026394 A1 disclose a spatial pelting board and a system for drying furs, for example mink furs, held stretched on spatial pelting boards. The drying system includes drying carts which are adapted to during the drying process to support a large number of pelting boards, which are fixed in the drying carts in upright position in mutually offset rows which, for example, consist of four pelting boards with furs that are fixed on the pelting boards by external fixing bags or fixing sleeves. In other words, a top plate of the drying cart is formed with eight rows of fixing holes in longitudinal direction, which in transverse direction are mutually offset in groups of four holes so that each transverse row only consists of four fixing holes.

After the drying process, the furs are to be pulled off the pelting boards, which preferably occurs while the pelting boards are yet fixed in the drying carts as the lower wide ends of the pelting boards are retained in a top plate of the drying cart by means of a central retainer pin.

The pulling of furs off the pelting boards itself is performed manually, entailing a very cumbersome and time-consuming work which in other words is relatively costly.

SUMMARY OF THE INVENTION

The invention is an apparatus which by means of relatively simple apparatus enables mechanising the otherwise very tedious and costly work of pulling the furs off the pelting boards while the latter still fixed in upright position in the drying carts.

The apparatus according to the invention includes a conveying tunnel through which the drying cart passes through; means for guiding a longitudinal side of the drying cart against and along a side of the conveying tunnel; transverse upper guide means for moving in rows upper pointed ends of the pelting boards retaining the furs into a position opposite transversely positioned rows of fixing means which clamp opposing narrow side edges of the fur at the pointed ends of the pelting boards; a secondary guide means for releasing in groups releasing pelting boards with furs; primary laterally displaceable lifting means for clamping a pointed end of the furs and successively pulling the row of furs off the pelting boards; and secondary lifting means for pulling the furs completely off the pelting boards and delivering the furs at an upper delivery position from which the furs are discharged from the apparatus.

By means of relatively simple mechanical means it hereby becomes possible to mechanise the otherwise very tedious and costly work of pulling the furs off the pelting boards while still fixed in upright position in the drying carts.

The apparatus according to the invention takes off dried furs from pelting boards disposed in an upright position in a drying cart with a top plate which is formed, for example, with eight longitudinal rows of fixing holes, which from a transverse direction form mutually offset rows, each provided with, for example, four fixing holes, the upper guide means are divided into two mutually offset groups or rows with, for example, four individual guide means for guiding every other one of the upper pointed ends of the pelting boards and the furs, respectively, into position opposite every other one of the fixing means.

The apparatus according to the invention is suitably designed so that the fixing means are arranged in one row of, for example, with eight clamping jaws interacting in pairs which are operated by a common displacement actuator, preferably via a drawbar.

With the intention of enabling height adjustment of the operating level of the apparatus depending on the actual length of pelting boards, the apparatus according to the invention may advantageously be designed so that the guide and fixing means are arranged on a common transverse support yoke which at opposite ends includes adjusting means for providing height adjustment of the support yoke with the intention of setting the operating level of the apparatus in dependence of the actual length of pelting boards.

With the intention of interchangeably operating several groups, each with four furs, the apparatus according to the invention is designed so that the primary lifting means are collectively arranged to be displaceable in a transverse direction of the apparatus and includes four individual sets of lifting jaws which in the original position are moved down over pointed ends of furs on the pelting boards, and which by upwards displacement clamp the furs, as each set of lifting jaws is connected with a separate lifting cylinder.

In order to keep the pointed ends of the furs in a position at the original position, the apparatus according to the invention may advantageously include interacting transverse retention arms, which from outer inactive positions spaced apart from the furs in the original position are pivotable inwards against opposing sides of the furs to fix the furs in the original position until the secondary lifting means are holding the furs.

The apparatus according to the invention may suitably be further designed so that the secondary lifting means are pivotable on a displaceable carriage at a side of the apparatus and include a common projecting lifting arm with mutually spaced parallel members which are provided with inflatable hoses along mutually facing inner sides.

The common lifting arm may thus in a simple way be moved down over free ends of four furs simultaneously, after which the inflatable hoses may be inflated and clamp the furs between the members. Then the furs may be drawn completely off the pelting boards and pulled upwards backwards to the discharge position.

With the object of achieving the required working space, the apparatus according to the invention is designed to include a transverse rod-shaped pivoting mechanism which via a unidirectional coupling, a pinion and a toothed rack are operated by a linear actuator or corresponding displacement actuator and the pivoting mechanism is movable to move rows and hold upper ends of released pelting boards away from the upper guide means and the clamping means.

BRIEF DESCRIPTION OF THE DRAWINGS

The invention is explained in more detail in the following with reference to the drawing in which.

DETAILED DESCRIPTION OF THE INVENTION

Figure 1:
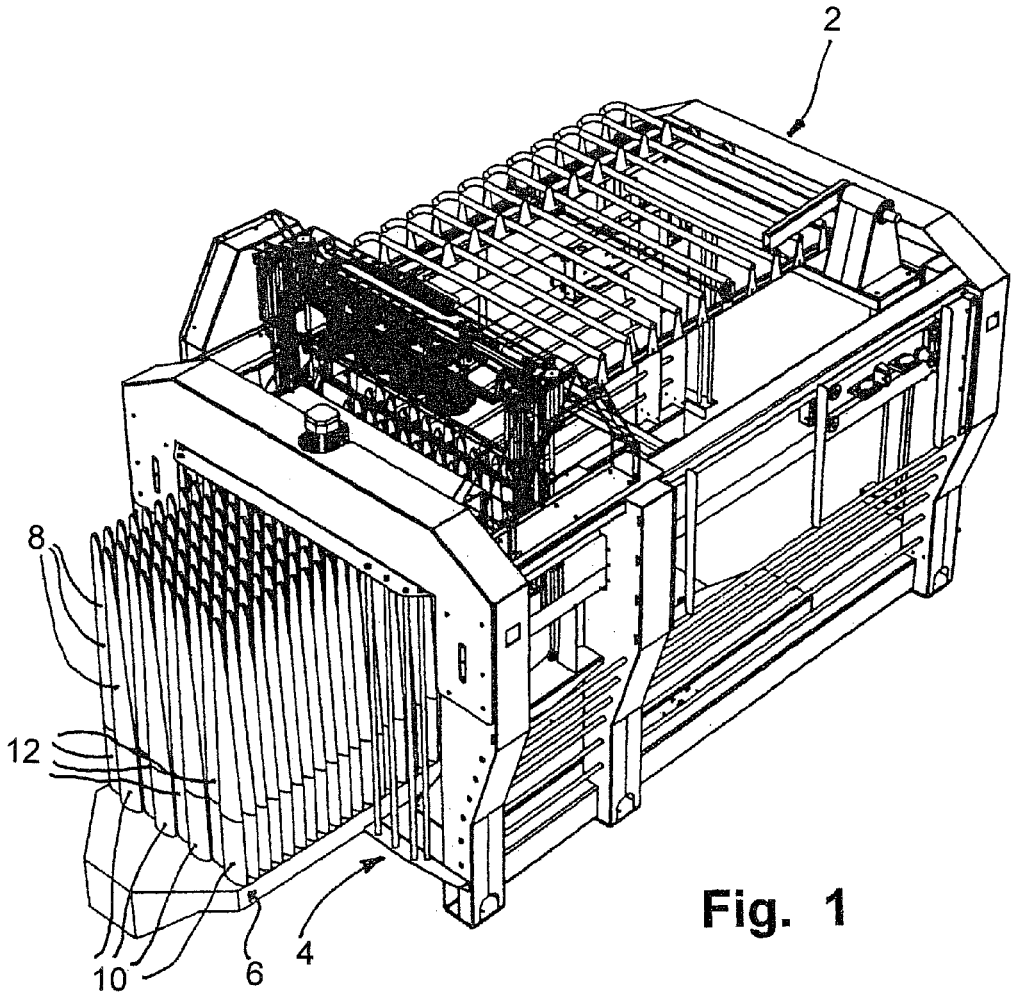
FIG. 1 shows a perspective view of an embodiment of an apparatus according to the invention for removal of furs from pelting boards arranged in a drying cart.
Figure 2:
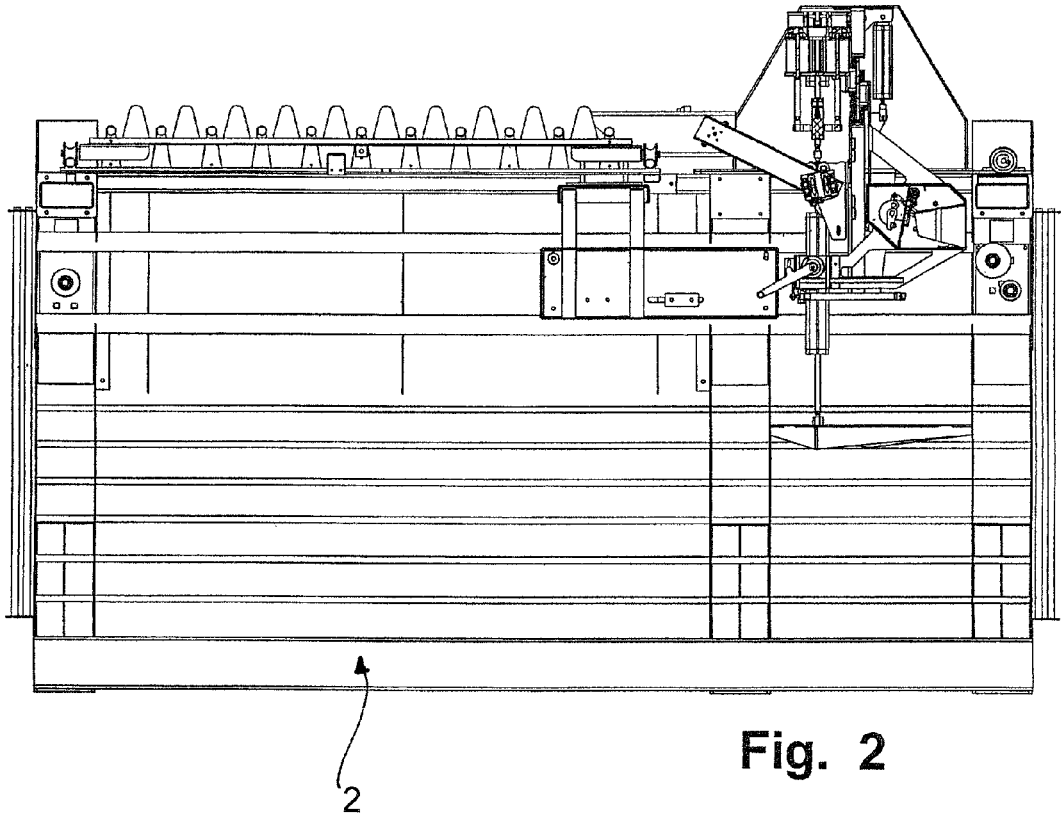
FIG. 2 shows a side view—partly in section—of the inventive apparatus shown in FIG. 1.
Figure 3:
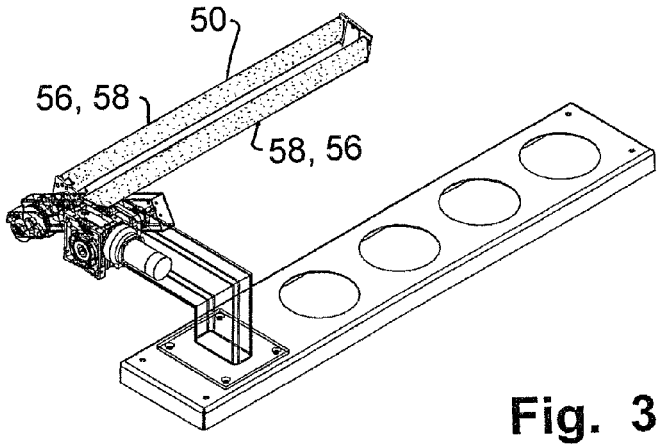
FIG. 3 shows a perspective view of an embodiment of a tertiary lifting means for an apparatus according to the invention.

The apparatus 2 shown in FIGS. 1 and 2 are designed with a conveying tunnel 4 for successively moving a drying cart 6 through the tunnel with a larger number of upright spatial pelting boards 8. The drying cart 6 is, for example, configured to contain up to about 200 pelting boards 8 on which are arranged standing upright in eight longitudinal rows, as the pelting boards 8—as seen in transverse direction—are mutually offset for the formation of transverse rows 10, 12 of four pelting boards each, so that every other transverse row 10 is displaced to the right and every other transverse row 12 is displaced to the left as seen in the longitudinal direction of the drying cart 6.

The pelting boards 8 are in a way (not illustrated) fixed in openings in an upper top plate of the drying cart, as the pelting boards 8 are provided at the wide ends with a central retainer pin which is formed with an arrow-shaped head. The pin has upper projecting edges which hold at the underside of the openings in the top plate in such a way that locking means may be released at each opening at once for each longitudinal row of openings of the drying cart 6. This way of fixing the pelting boards 8 upright in the drying cart 6 entails that the pelting boards may move somewhat in the longitudinal direction relative to the drying cart 6.

Figure 4:
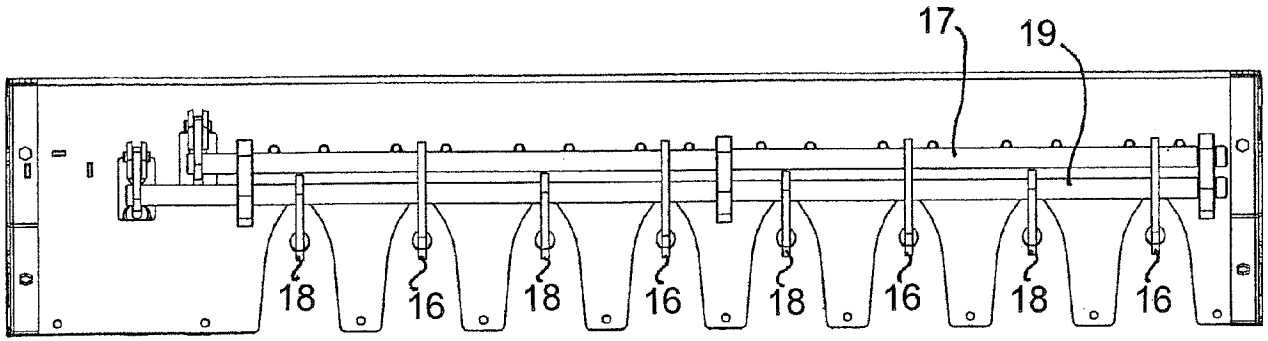
FIG. 4 shows a plan view of an embodiment of support yoke for common upper guide means for the apparatus according to the invention.
Figure 5:
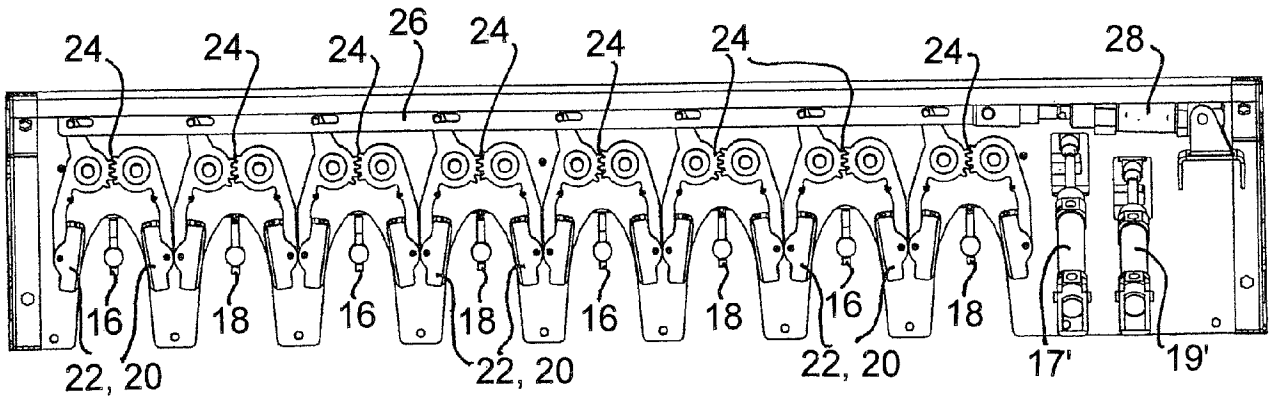
FIG. 5 shows predominantly a plan view of the support yoke shown in FIG. 4, which viewed from the opposite side shows an embodiment of fixing means for upper pointed ends of furs on pelting boards which are moved into position opposite clamping jaws by means of the guide means shown in FIG. 4.
Figure 8:
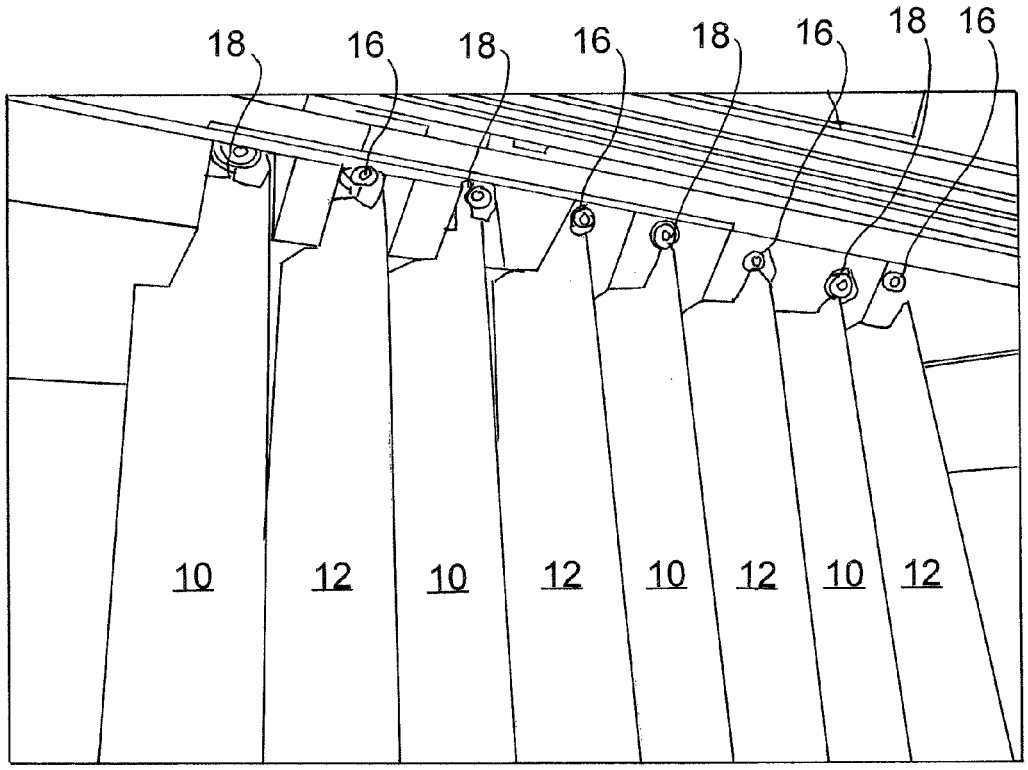
FIG. 8 shows a photographic view illustrating how upper ends of pelting boards (with furs on the boards) can be kept in position in one row by means of upper guide means.
Figure 9:
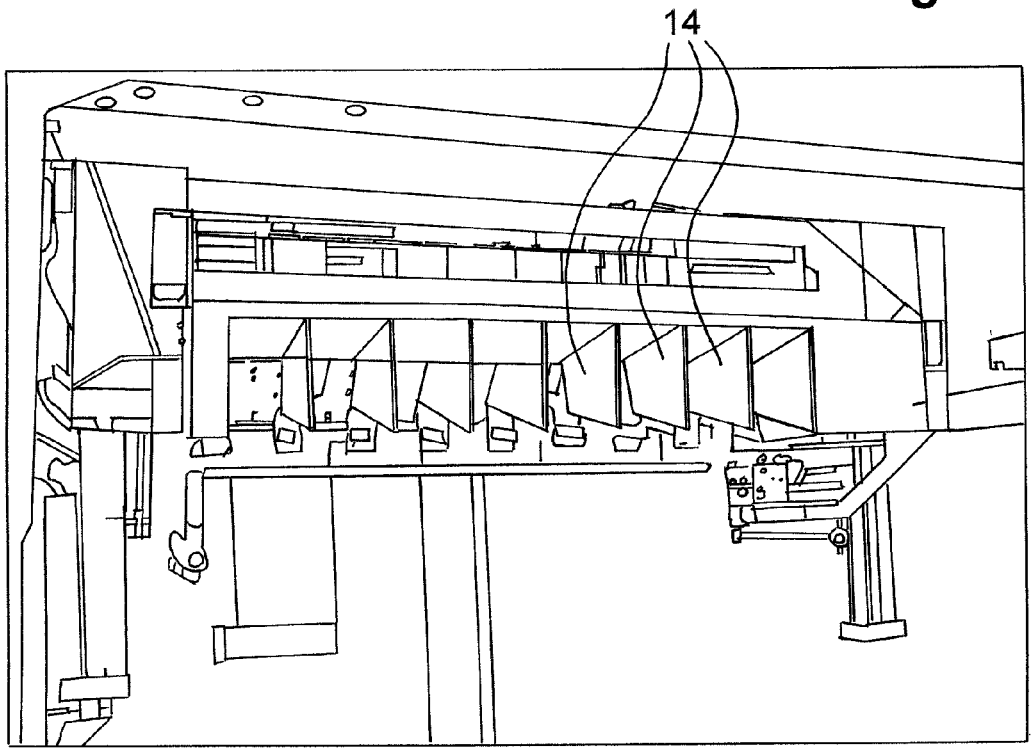
FIG. 9 shows a photographic view of longitudinal upper insertion funnels for upper ends of longitudinal rows of pelting boards holding furs.
Figure 10:
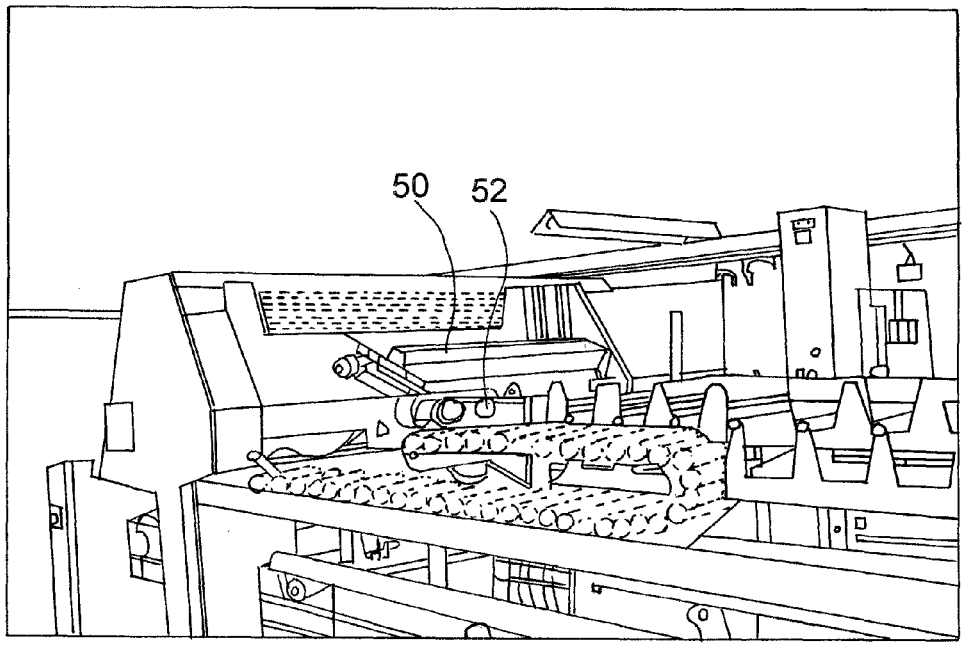
FIG. 10 shows a photographic view of an embodiment of a tertiary lifting means providing for the last transport of furs to an upper discharge position of the apparatus according to the invention.

FIG. 9 illustrates upper inserting funnels 14 which are adapted to guide upper ends of the pelting boards 8 into position laterally relative to FIG. 8, so that the upper ends of the pelting boards 8 are fixed on a common transverse row behind upper guide means 16, 18, which are also shown in FIG. 4. Behind the guide means 16, 18, eight interacting fixing means 20 are shown in FIG. 5, each consisting of two clamping jaws 22 at each their tongs-like device 24, and which is operated by a transverse drawbar 26 and an actuator (cylinder) 28.

Figure 6:
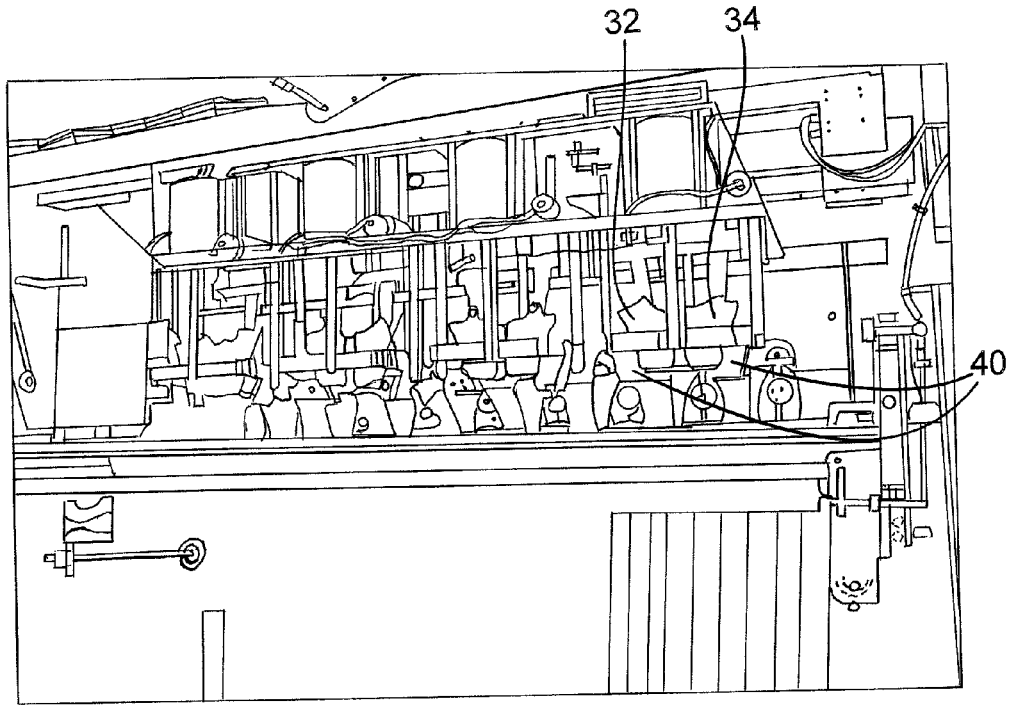
FIG. 6 shows a photographic view of an embodiment of secondary lifting means for an apparatus according to the invention.

In the situation shown in FIG. 8, the upper ends of the pelting boards 8 (which for the sake of clarity are shown without furs) are slightly buckled backwards. The guide means 16, 18 are, as most clearly shown in FIG. 4, divided into two groups 10, 12 of four pelting boards 8 each in transverse direction, each group consisting of every other pelting board 8 in the transverse row shown in FIG. 8. In other words, the guide means 16 and 18, which are mounted at each their pivot 17 and 19 with associated pivot cylinders 17' and 19', may be used for selectively releasing every other pelting board 8 of the transverse row shown in FIG. 8, so that the released four pelting boards will automatically be pivoted forward to a position where laterally displaceable secondary lifting means 30 (FIGS. 6 and 7) can be moved down over the pointed ends of the pelting boards 8 holding furs for gripping the furs at the pointed ends of the pelting boards 8.

Each of the lifting means 30 includes two gripping claws 32, 34 which are pivotably suspended internally of an enclosing frame 36 which at opposing short sides 38 have wedges 40 interacting with complementing wedge faces 42 of the gripping claws 32, 34.

The lifting means 30, which are operated by each their lifting cylinder 44, are used in the following way:

The gripping claws 32, 44 are moved down around the pointed ends of the pelting boards 8 externally of the furs. At the very first upwards movement of the lifting means 30, the wedges 40 will cause the gripping claws 32, 34 to be pressed together around the fur, clamping it during the first part of the upwards movement, whereby possible play in longitudinal direction of the pelting boards 8 is eliminated before the actual pull is exerted in the gripping claws 32, 34 for pulling the furs off the pelting boards 8.

In order to improve friction between the fur and the gripping claws 32, 34, these may advantageously be designed with a friction surface which, for example, may be produced by providing the gripping faces of the gripping claws 32, 34 with thin strips of sandpaper or emery cloth.

Figure 7:
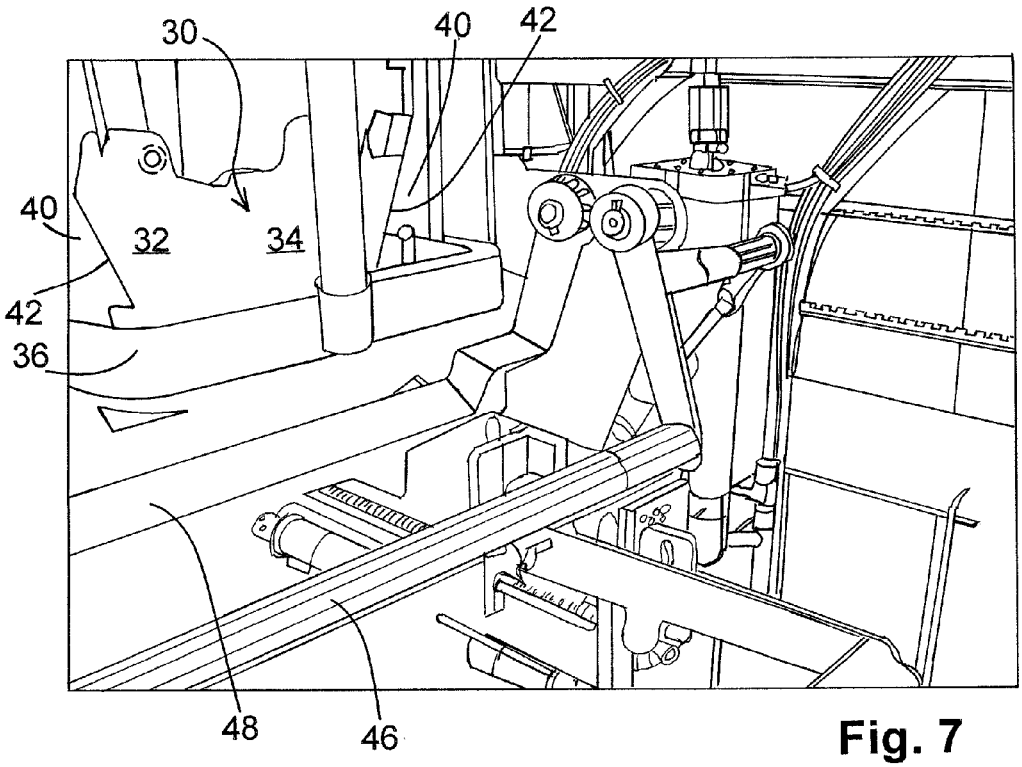
FIG. 7 shows a photographic view of some details of an apparatus according to the invention.

When the furs have been pulled free of the pelting boards 8, the upper end part of the furs will be fixed between the transverse retention arms 46, 48 which are pivoted in against the furs from each their side of these (FIG. 7).

Subsequently, free upper pointed ends of the furs may be gripped by secondary lifting means 50 (FIGS. 3, 10, 12, and 13) which are pivotable on a displaceable carriage 52 at a side of the apparatus 2 and which include a common projecting lifting arm 54 with mutually spaced parallel members 56 provided with inflatable hoses 58 along mutually facing inner sides. In other words, upper pointed ends of four furs are at once clamped between the members 56 by inflating the hoses 58, after which the lifting arm 54 is moved upwards and forwards to a discharge position upon the apparatus 2, where the air is let out of the hoses 58 for releasing the furs.

Figure 11:
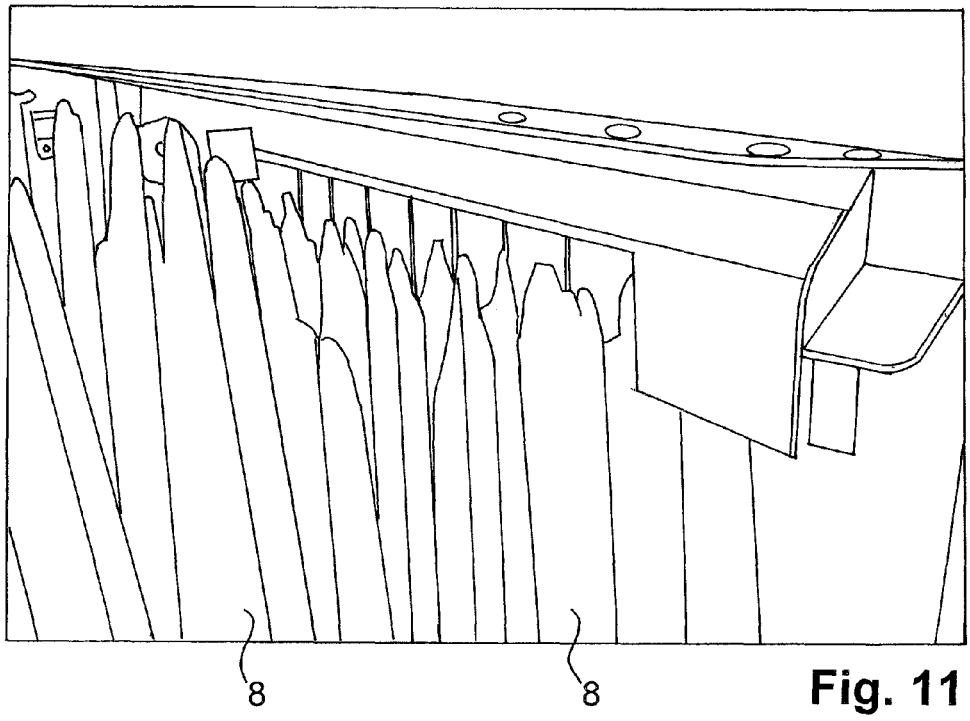
FIG. 11 shows a photographic view for illustrating that the apparatus according to the invention may operate with pelting boards of different lengths.
Figure 12:
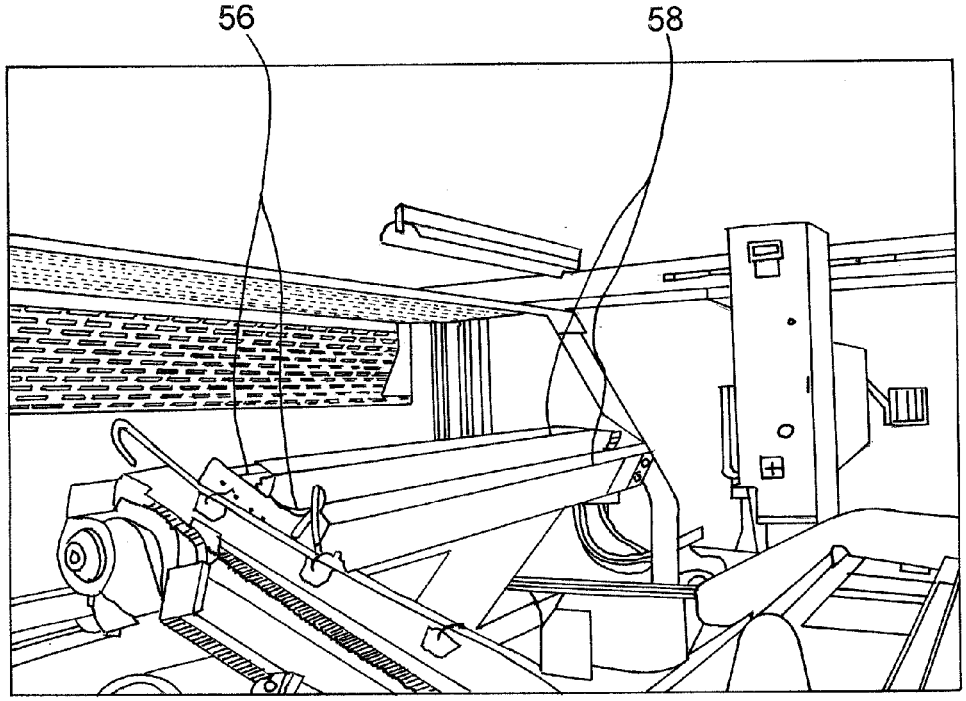
FIG. 12 shows a photographic detail of the tertiary lifting means shown in FIG. 10 with a projecting transverse lifting arm with inflatable hoses, between which pointed ends of furs can be clamped by inflating the hoses.
Figure 13:
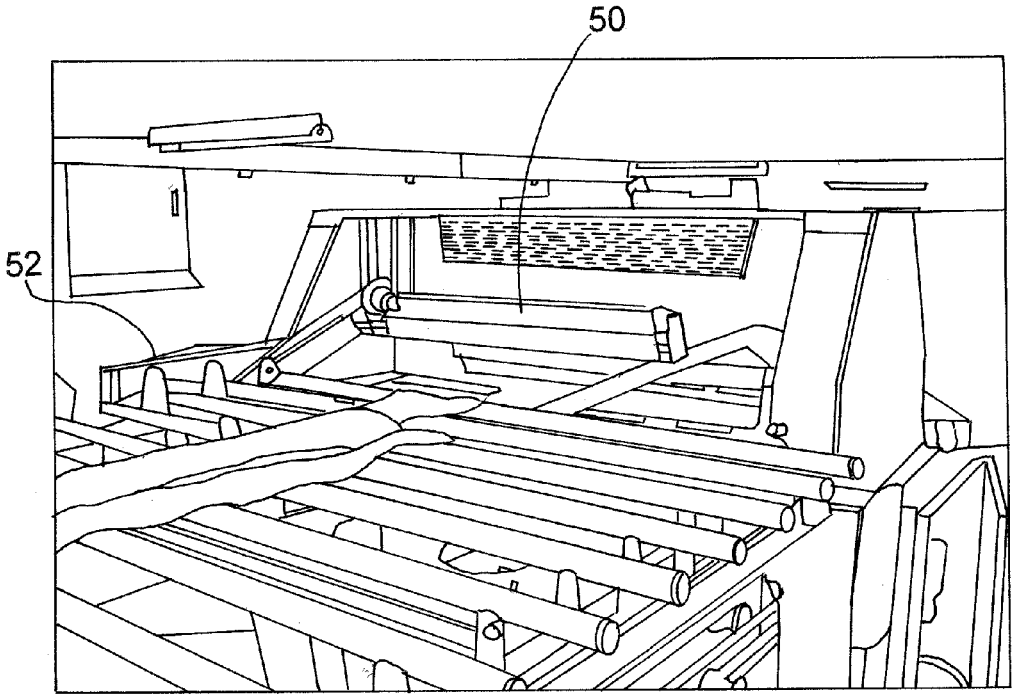
FIG. 13 shows a photographic view of the top of the apparatus according to the invention, where the above-mentioned discharge position for the tertiary lifting means is shown.

In FIG. 11 is illustrated how the apparatus 2 according to the invention may be used in connection with pelting boards 8 with different lengths. However, in practice one drying cart 6 will not contain pelting boards with different lengths.

Figure 14:
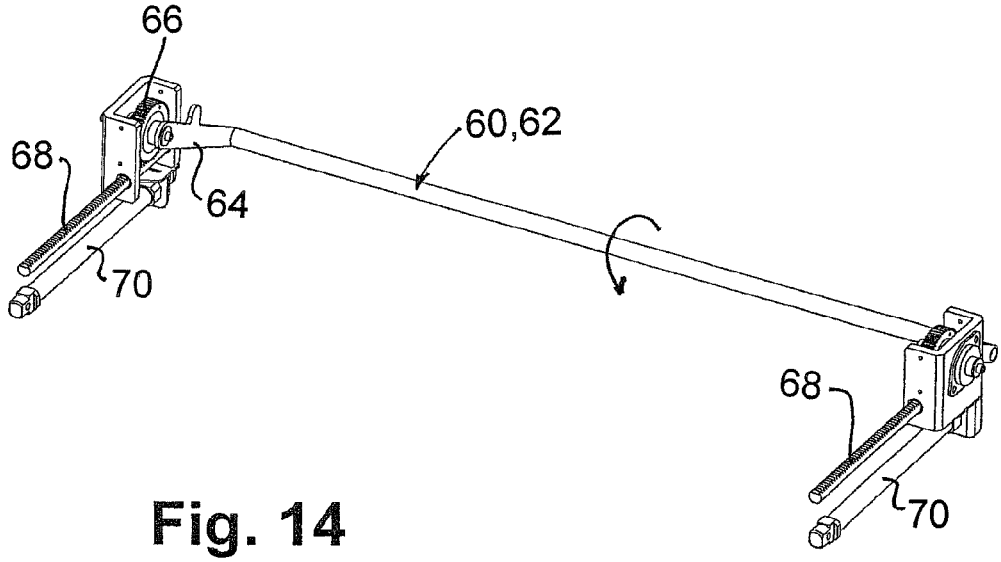
FIG. 14 shows a perspective view of a leafing unit for an apparatus according to the invention.
Figure 15:
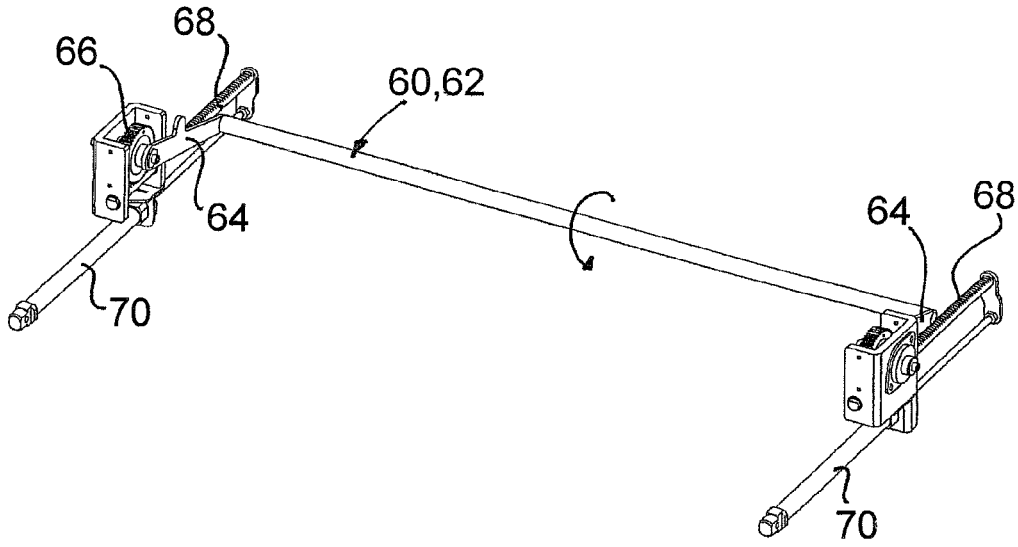
FIG. 15 shows a perspective view of the leafing unit in FIG. 14, shown with actuated toothed rack and linear actuator, respectively.

FIGS. 14 and 15 illustrate the indicated leafing mechanism 60 where a transverse rotating leafing arm 62 is used for moving and keeping distance to already released pelting boards 8 with the intention of ensuring the required working space for the primary functions of the apparatus.

Short pivoting arms 64 connect the leafing arm 62 with a unidirectional coupling via a pinion 66 which is rotated by engagement with a toothed rack 68 which is moved back and forth by means of a linear actuator 70. For example, the leafing arm 62 will always rotate in the same direction though driven by a reciprocating toothed rack 68.

The invention claimed is:

1. An apparatus for removal of dried furs from pelting boards upon which the furs during drying are fixed in an upright position comprising:

a drying cart including a plate to which a wide end of the pelting boards is fixed with the upright pelting boards on which the furs are fixed being arranged in transverse and longitudinal rows;

a conveying tunnel for successively passing the drying cart through the tunnel;

means for guiding a longitudinal side of the drying cart against and along a side of the conveying tunnel;

transverse upper guide means for moving by rows upper pointed ends of the pelting boards holding the furs into a position opposite transversely positioned rows of fixing means for clamping opposing narrow side edges of the fur at the pointed ends of the pelting boards;

second guide means for releasing a group of pelting boards holding furs;

first displaceable lifting means for clamping a pointed end of the furs and successively pulling a row of furs off the pelting boards; and secondary lifting means for pulling the furs off of the pelting boards and delivering the furs at an upper delivery position from where the furs are discharged from the apparatus.

2. An apparatus according to claim 1 wherein the pelting boards are disposed in an upright position in a drying cart with a top plate formed with longitudinal rows of fixing holes, which from a transverse direction form mutually offset rows, each row being provided with fixing holes, the second guide means being divided into two mutually offset groups or rows including individual guide means for guiding every other one of the upper pointed ends of the pelting boards and the furs, into a position opposite every other of the fixing means.

3. An apparatus according to claim 1, wherein the fixing means are in a row including clamping jaws interacting in pairs which are operated by a common displacement actuator.

4. An apparatus according to claim 1, wherein the means for guiding and fixing are disposed in a common transverse support yoke which at opposite ends thereof includes means for adjusting height of the support yoke to set the operating level of the apparatus in dependence upon an actual length of pelting boards.

5. An apparatus according to claim 1, wherein the first lifting means are collectively displaceable in a transverse direction of the apparatus and include sets of lifting jaws which in an original position are movable down over pointed ends of furs on the pelting boards, and which upon upward displacement clamps the furs, with each set of lifting jaws being connected with a lifting cylinder.

6. An apparatus according to claim 1, including interacting transverse retention arms, which are pivotable inwardly from outer inactive positions spaced apart from the furs in the original position against opposing sides of the furs for fixing the furs in an original position until the second lifting means hold of the furs.

7. An apparatus according to claim 1, wherein the second lifting means are pivotable on a displaceable carriage at a side of the apparatus and include a common projecting lifting arm with mutually spaced parallel members which are provided with inflatable hoses along mutually facing inner sides.

8. An apparatus according to claim 1, including a transverse pivoting mechanism which via a unidirectional coupling, a pinion and a toothed rack are operated by a displacement actuator, the pivoting mechanism being movable to move in rows pelting boards and to hold upper ends of released pelting boards away from the upper guide means and the clamping means.

9. An apparatus according to claim 2, including a transverse pivoting mechanism which via a unidirectional coupling, a pinion and a toothed rack are operated by a displacement actuator, the pivoting mechanism being movable to move in rows pelting boards and to hold upper ends of released pelting boards away from the upper guide means and the clamping means.

10. An apparatus according to claim 3, including a transverse pivoting mechanism which via a unidirectional coupling, a pinion and a toothed rack are operated by a displacement actuator, the pivoting mechanism being movable to move in rows pelting boards and to hold upper ends of released pelting boards away from the upper guide means and the clamping means.

11. An apparatus according to claim 4, including a transverse pivoting mechanism which via a unidirectional coupling, a pinion and a toothed rack are operated by a displacement actuator, the pivoting mechanism being movable to move in rows pelting boards and to hold upper ends of released pelting boards away from the upper guide means and the clamping means.

12. An apparatus according to claim 5, including a transverse pivoting mechanism which via a unidirectional coupling, a pinion and a toothed rack are operated by a displacement actuator, the pivoting mechanism being movable to move in rows pelting boards and to hold upper ends of released pelting boards away from the upper guide means and the clamping means.

13. An apparatus according to claim 6, including a transverse pivoting mechanism which via a unidirectional coupling, a pinion and a toothed rack are operated by a displacement actuator, the pivoting mechanism being movable to move in rows pelting boards and to hold upper ends of released pelting boards away from the upper guide means and the clamping means.

14. An apparatus according to claim 7, including a transverse pivoting mechanism which via a unidirectional coupling, a pinion and a toothed rack are operated by a displacement actuator, the pivoting mechanism being movable to move in rows pelting boards and to hold upper ends of released pelting boards away from the upper guide means and the clamping means.

* * * * *